United States Patent [19]

Palladino, Jr.

[11] Patent Number: 4,720,103

[45] Date of Patent: Jan. 19, 1988

[54] TRAINING DEVICE FOR FOOTBALL PLAYERS

[76] Inventor: William D. Palladino, Jr., Coventryville Rd., P.O. Box 234, Pottstown, Pa. 19464

[21] Appl. No.: 817,898

[22] Filed: Jan. 13, 1986

[51] Int. Cl.[4] ..... A63B 67/00

[52] U.S. Cl. ..... 273/55 R; 272/130

[58] Field of Search ..... 273/55 R; 272/116, 117, 272/118, 130, 133, 132, 134, 135, 136, 137, 139, 72, 142, 20, 4

[56] References Cited

U.S. PATENT DOCUMENTS

| | | | |
|---|---|---|---|
| 829,580 | 8/1906 | Folsom | 273/55 R |
| 2,255,711 | 9/1941 | Noor | 273/55 R |
| 2,940,957 | 6/1960 | Britt | 273/55 R |
| 3,062,547 | 11/1962 | Kopp | 273/55 R |
| 3,514,105 | 5/1970 | Pillard | 273/55 R |
| 3,578,324 | 5/1971 | Alvey | 273/55 R |
| 3,674,265 | 7/1972 | Sheets | 273/55 R |
| 3,827,690 | 8/1974 | Rogers | 273/55 R |
| 3,866,914 | 2/1975 | Jackson | 272/117 |
| 3,897,060 | 7/1975 | Jennings | 173/55 R |
| 3,997,160 | 12/1976 | George | 273/55 R |
| 4,067,571 | 1/1978 | Rogers | 273/55 R |
| 4,087,089 | 5/1978 | Forrest | 273/55 R |
| 4,140,315 | 2/1979 | Page | 273/55 R |
| 4,186,922 | 2/1980 | Ketchum | 273/55 R |
| 4,333,644 | 6/1982 | Lambert, Jr. et al. | 272/134 |
| 4,354,675 | 10/1982 | Barclay et al. | 272/118 |

FOREIGN PATENT DOCUMENTS

| | | | |
|---|---|---|---|
| 299350 | 10/1928 | United Kingdom | 272/4 |

OTHER PUBLICATIONS

"Faller" 1967, p. 55.

*Primary Examiner*—Richard C. Pinkham
*Assistant Examiner*—T. Brown
*Attorney, Agent, or Firm*—William H. Eilberg

[57] ABSTRACT

A device for training football players is disclosed. The device trains the user in the art of blocking. The apparatus includes a frame which defines an upwardly-sloping track, and a carriage which moves along the track. The carriage is connected, by a pulley system, to a hydraulic or pneumatic cylinder, or equivalent device, for imparting resistance to the movement of the carriage along the track. Forcing the carriage upwardly along the track also pushes a piston into the cylinder, retarding the movement of the carriage. A second pulley is also provided for retracting the piston from the cylinder when the carriage is moved back to its original position. The device trains the player to shift his weight while blocking, so as to tend to lift the opposing player from the ground. The amount of resistance to the movement of the carriage can be varied to simulate opposing players of varying weights.

12 Claims, 4 Drawing Figures

TRAINING DEVICE FOR FOOTBALL PLAYERS

BACKGROUND OF THE INVENTION

The present invention relates to the field of sports training devices, and, in particular, to the field of devices for training football players in the art of blocking.

Many devices have been created for training football players in the art of playing the game. Such devices are usually designed to train the player in a specific facet of the game. For example, there are devices which help a player to improve his skills in tackling, passing, kicking, and blocking.

One example of a device for training players in the art of blocking is shown in U.S. Pat. No. 4,087,089. The patent describes a device for training football linemen, and has a movable member mounted on the frame, the resistance to movement of the member being adjustable. The device can thereby simulate various conditions of play.

Another device for teaching the art of football blocking is shown in U.S. Pat. No. 4,140,315. This device comprises a frame having an adjustably weighted member which is adapted to be lifted by contact with the user's shoulder.

U.S. Pat. No. 3,578,324 also shows a device for training football players to block their opponents. The device has a movable member which is pushed by the user, and which automatically thrusts back towards the user, simulating the action of an opposing player. Another device for training football players in blocking techniques is shown in U.S. Pat. No. 3,897,060. The latter patent uses a hydraulic cylinder to absorb the shock from the forward advance of the user, and also responds to the user's advance by thrusting back towards the user.

Many of the football training devices of the prior art comprise sleds which are designed to move along horizontal tracks. Examples of such sleds are shown in U.S. Pat. Nos. 3,674,265, 3,827,690, and 3,062,547.

It has been found that the most effective way to block an opposing player is to exert a force on the opponent which tends to lift the opponent from the ground. The player first advances towards the opponent while moving horizontally, and, upon making contact with the opponent, shifts his weight so that his momentum is directed vertically. The horizontal momentum generated while running is therefore converted into a vertically-directed force which tends to lift the opposing player. The player doing the blocking must smoothly pivot his body, from the hips, to accomplish this change of direction of force. The lifting motion described above is found to be the most efficient use of the player's weight so as to render the opposing player momentarily unable to help his teammates.

While there are many devices, in the prior art, which teach the art of blocking, none of these devices promotes the mastery of the motions described above. Most of the blocking devices merely train a player to charge towards an object, and provide some resistance to the force exerted by the charging player. The present invention provides a device which specifically develops the ability of the player to control his momentum so as to lift the opposing player, and to disable that player momentarily. The invention can also be used simply as an exercise device, even by persons who are not trying to improve their football skills.

SUMMARY OF THE INVENTION

The present invention comprises a generally rigid frame, the frame defining a track upon which a carriage is constrained to move. The track has a horizontally-disposed portion and an upwardly-sloping portion. The carriage is attached to the track by a set of wheels fitting around the track, and thereby rolls along the track. The carriage includes a pair of padded arms which can be grasped by the user of the apparatus.

The device also includes means for imparting resistance to the upward motion of the carriage along the track. In the preferred embodiment, this resistance means comprises a hydraulic or pneumatic cylinder, and a piston inserted into the cylinder, the piston being connected, by a pulley system, to the carriage. As the carriage is pushed up the track, the pulley tends to force the piston into the cylinder. Pressurized fluid stored in the cylinder resists the movement of the piston, and thereby resists the movement of the carriage.

As the carriage is pulled down the track, another pulley retracts the piston from the cylinder, preparing for another cycle of operation. The amount of resistance to movement of the carriage can be adjusted by varying the hydraulic or pneumatic pressure in the cylinder. The cylinder can also be replaced with a set of weights, or by any other equivalent means of generating an opposing force.

The device can be used by pushing the carriage along the horizontal portion of the track and then upward, along the sloping portion of the track. Alternatively, only the upwardly-sloping portion of the track can be used. When the entire track is employed, the user of the device can simulate a forward charging movement towards an opponent, and then an upward movement designed to lift the opponent from the ground. The device thereby enables the user to practice shifting his weight so as to achieve the desired effect on his opponent.

It is therefore an object of the present invention to provide a training device which aids a football player in perfecting the art of blocking.

It is another object of the invention to provide a training device which teaches a football player to shift his weight so as to tend to lift his opponent from the ground.

It is another object of the invention to provide a training device for teaching a football player to block an opponent, wherein the resistance generated by the device can be varied.

It is another object of the invention to provide a device as described above, wherein the device can also be used as an ordinary exercise device.

It is another object of the invention to provide a device as described above, wherein the device occupies a relatively small space, and wherein the device can be easily stored and used indoors.

It is another object of the invention to provide a device for training football players between football seasons.

Other objects and advantages of the present invention will be apparent to those skilled in the art, from a reading of the following brief description of the drawings, the detailed description of the invention, and the appended claims.

DETAILED DESCRIPTION OF THE INVENTION

Figure 1:
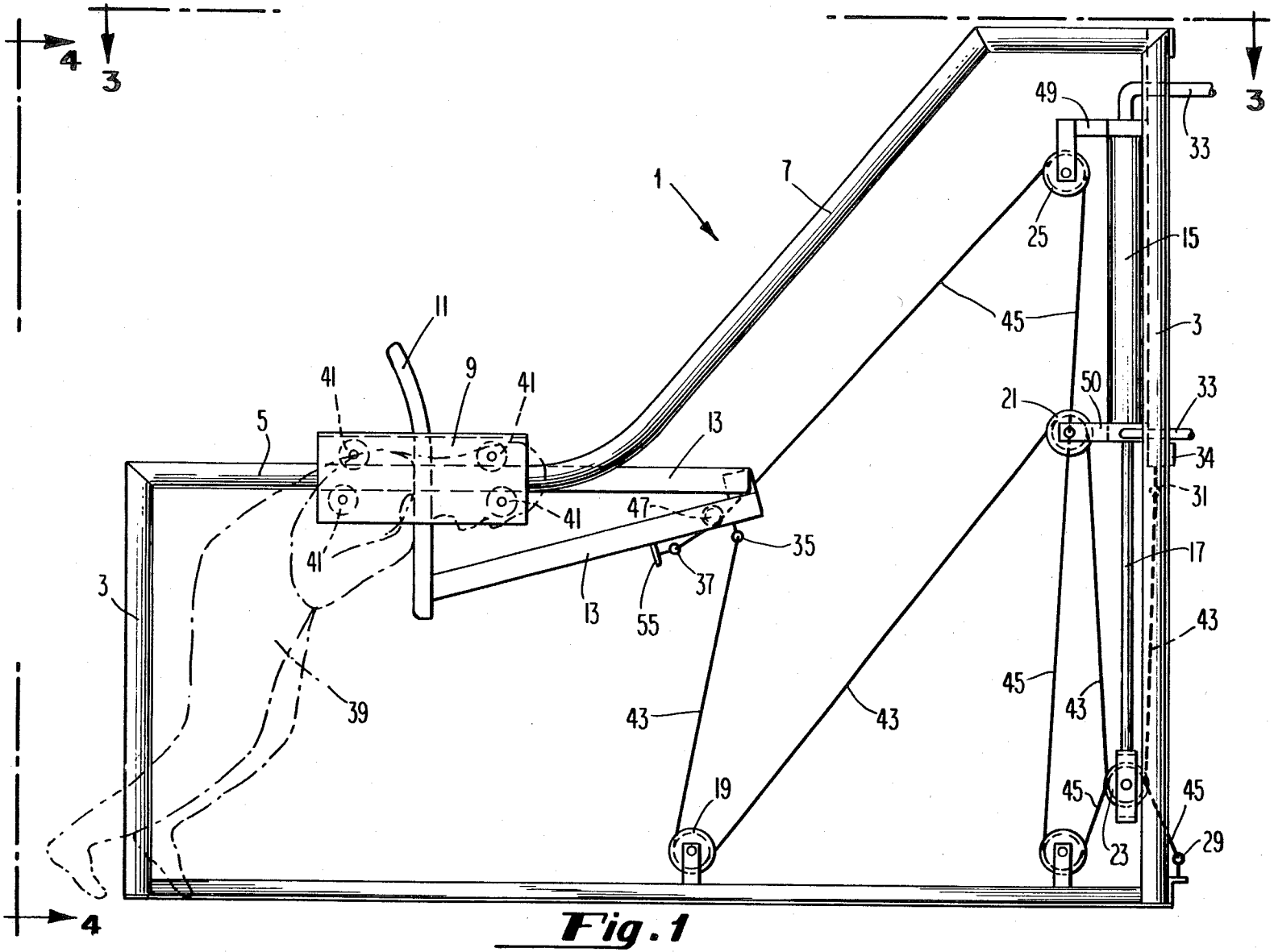
FIG. 1 is a side elevational view of the training device, showing a user moving the carriage along the horizontal portion of the track.
Figure 2:
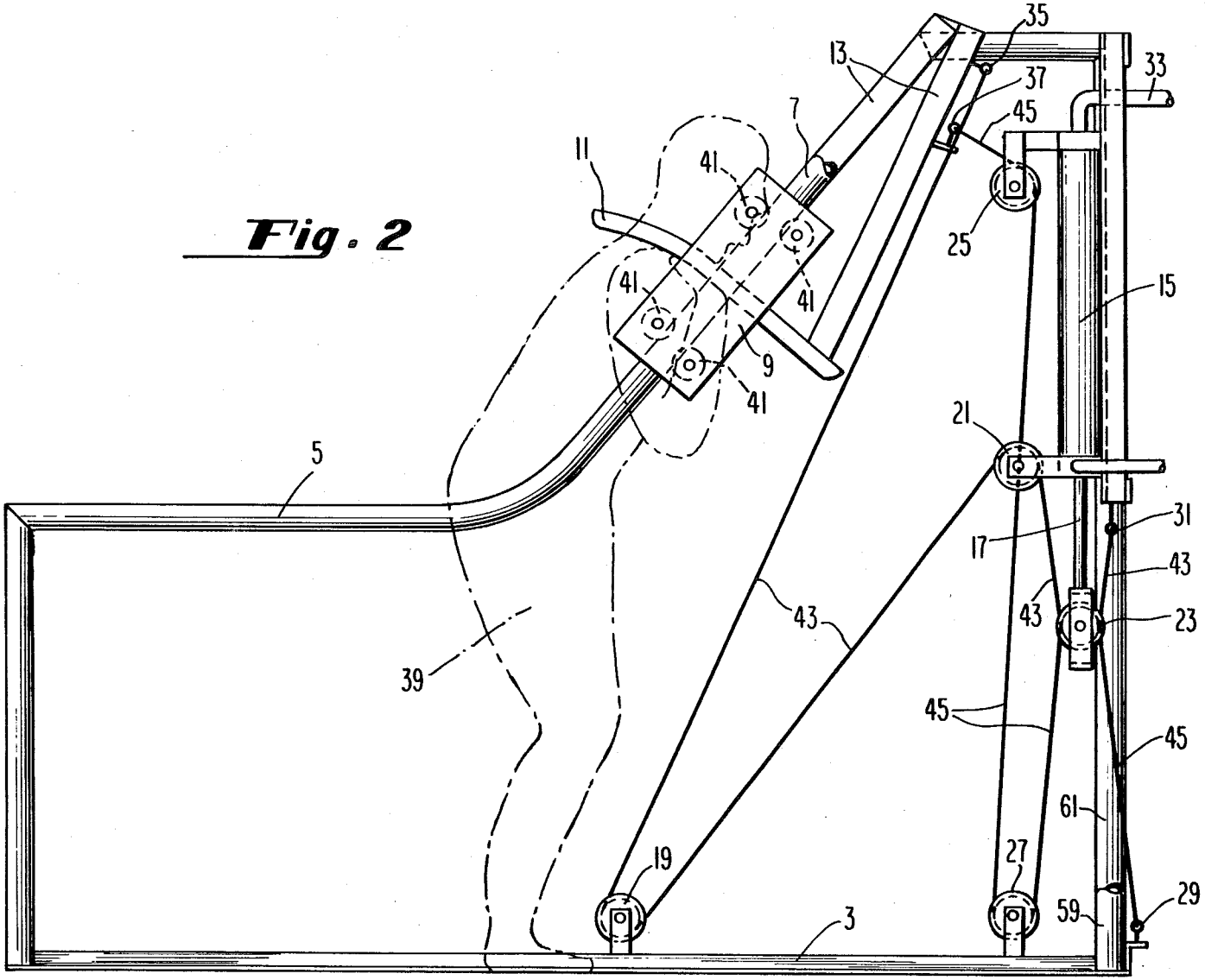
FIG. 2 is another side elevational view of the training device, showing the user moving the carriage along the upwardly-sloping portion of the track.

The structure of the training device of the present invention is shown in the elevational views of FIGS. 1 and 2. FIG. 1 shows training device 1 comprising frame 3, the frame including a track defined by horizontal track portion 5 and upwardly-sloping track portion 7. Carriage 9 is adapted to move along the track. Carriage 9 has rollers 41 which hold the carriage onto the track, but which also permit the carriage to roll in both directions along the track. The carriage 9 is constructed in two substantially identical pieces, both of which are mounted on opposite sides of the frame. In this specification, the term "carriage" will be used in the singular, but it is understood that the term includes both pieces. Similarly, the term "track" will be used in the singular, while it is understood that the track includes two pieces.

The carriage 9 has a pair of padded handlemembers 11, only one of which is visible in FIG. 1. The user 39 of the training device 1 presses forward against handle members 11, as shown. Carriage 9 also has a carriage arm 13 which provides a means for connection of the carriage to a pulley system, to be described below.

Hydraulic or pneumatic cylinder 15 is mounted on frame 3, and is provided with fluid conduits 33 which communicate with a suitable source of pressurized fluid (not shown). Piston 17 is adapted for insertion into cylinder 15. FIG. 1 also shows cross member 34, which is one of the structural members for frame 3.

The training device includes two pulley systems, to be described below. The first pulley system generates resistance to movement of the carriage 9, as the carriage is pushed up the track. The second pulley system retracts piston 17, to its original position, when the carriage is moved down the track.

The first pulley system comprises cord 43 and pulleys 19, 21, and 23. Pulley 25 is attached to frame 3 by bracket 49. Cord 43 is attached to the end of carriage arm 13, by means of eyebolt 35. Cord 43 passes around pulley 19, next around pulley 21, then around pulley 23, and is then affixed to frame 3 by eyebolt 31. Eyebolt 31 and part of cord 43 are shown in dotted outline, since these components are hidden by frame 3, in FIG. 1. In FIG. 2, however, frame portion 59 is shown in a broken-away configuration, so that rear frame portion 61, and also the entire cord 43, are visible.

The second pulley system comprises cord 45 and pulleys 25, 27, and 23, as well as small pulley 47. Pulley 21 is attached to frame 3 by bracket 50. Cord 45 is affixed to eyebolt means 37, which is attached to carriage arm 13 by fastener 55. The cord passes along small pulley 47, around pulley 25, next around pulley 27, and then around pulley 23. Cord 45 is then anchored to the frame by eyebolt 29. It should be appreciated that pulley 23 is a double pulley, as it must accommodate separate cords 43 and 45. This double structure will be made clearer in the other figures.

Figure 3:
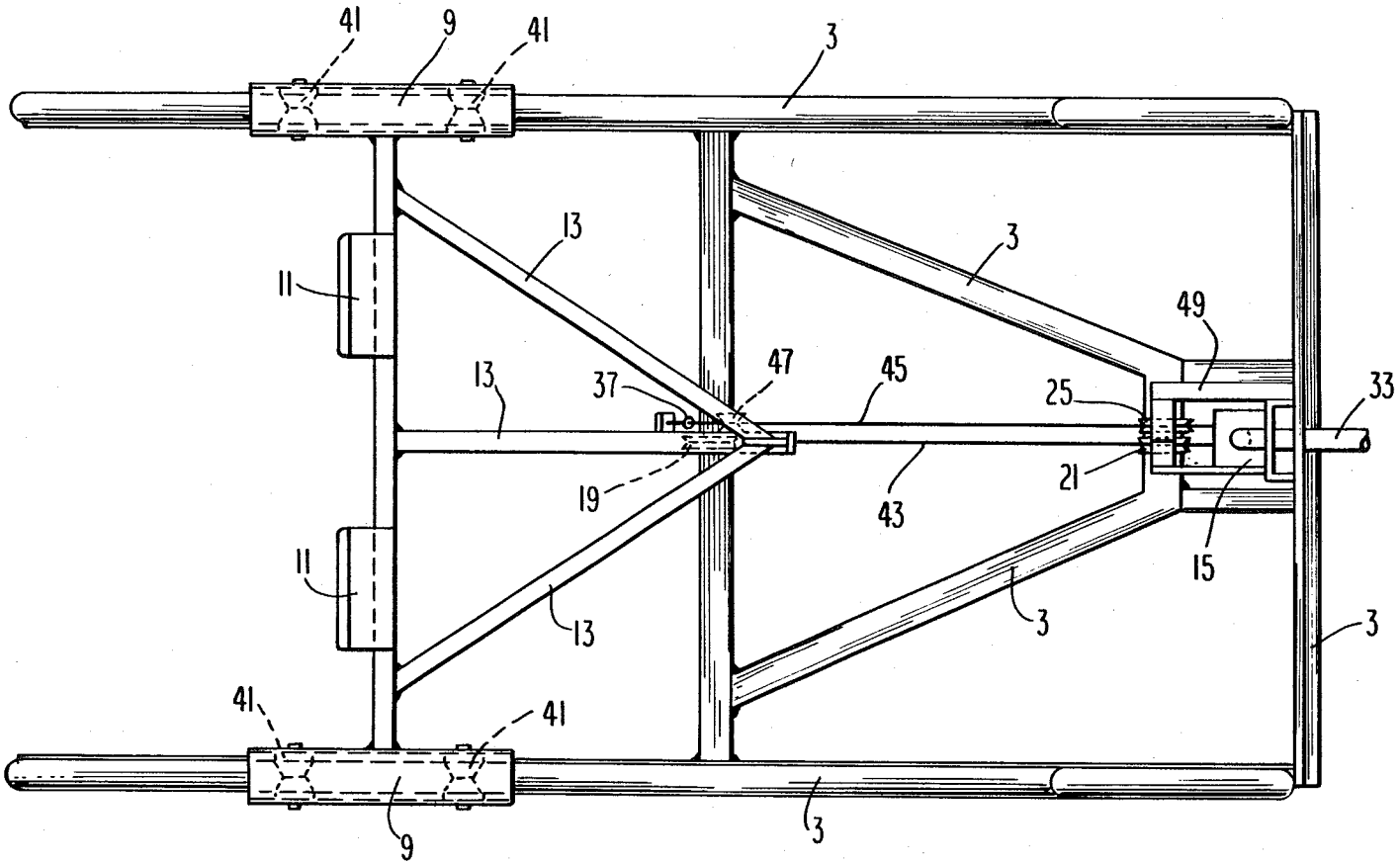
FIG. 3 is a top view of the apparatus, taken along the line 3—3 of FIG. 1, showing the frame and carriage structure.

FIG. 3 is a top view which shows more details of the apparatus. The structure of carriage arm 13 is more clearly shown, as is that of frame 3. The figure also shows handle members 11 and both pieces of carriage 9, connected to the track by rollers 41. FIG. 3 also shows some of the pulleys described above. Similar reference numerals are used to designate similar items.

Figure 4:
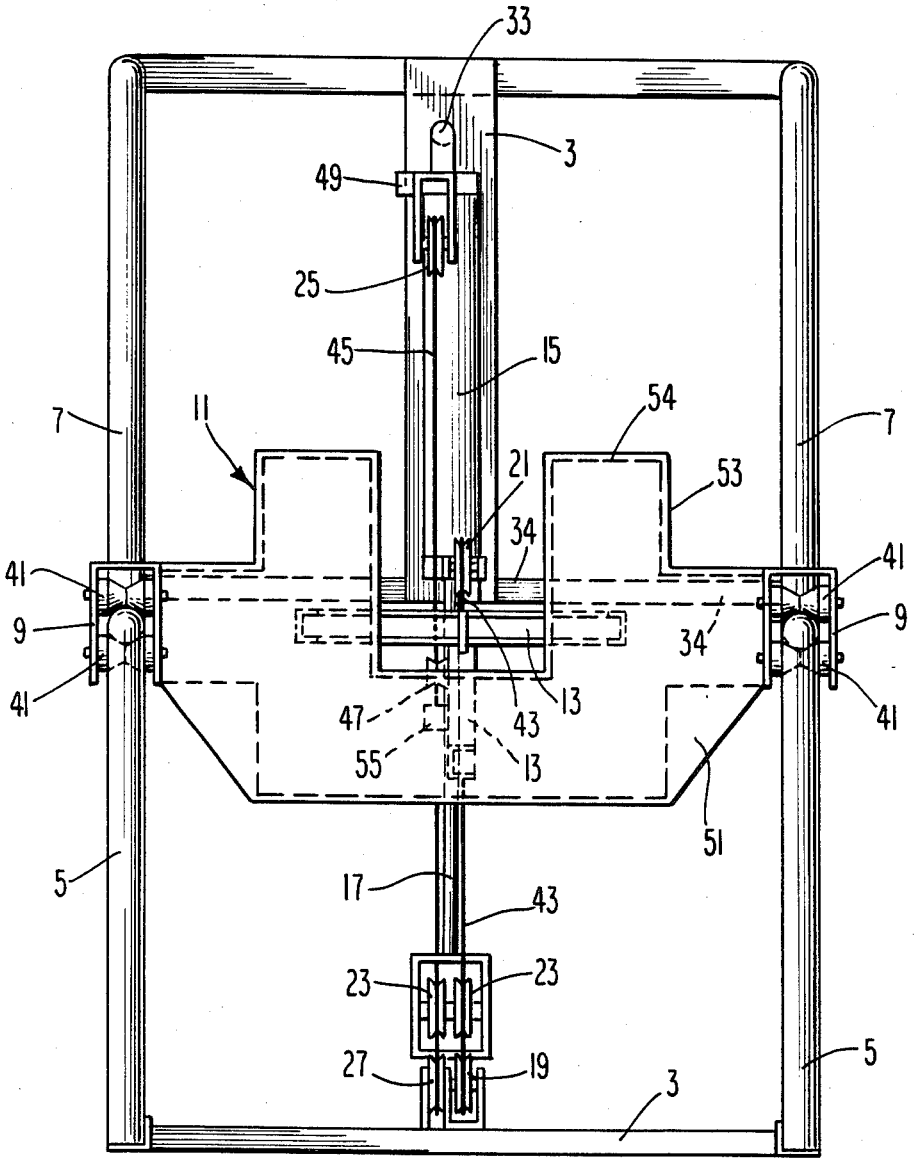
FIG. 4 is an end view, taken along the line 4—4 of FIG. 1, showing more details of the carriage and pulley system.

FIG. 4 is an end view of the apparatus, as would be seen from the direction of a user approaching the device, as shown in FIGS. 1 and 2. FIG. 4 more clearly shows the position of handle members 11. Line 53 defines the outer boundary of the handle members, while dotted line 54 defines the boundary of a rigid skeleton forming the core of the handle members. The region indicated by reference numeral 51 represents the padding disposed around the rigid skeleton 54. The skeleton, like the frame, is preferably made of metal. FIG. 4 also shows the position of the three members of the carriage arm 13.

In FIG. 4, there is also shown cylinder 15, which is visible against the backdrop of a portion of the frame 3. The figure also shows a portion of piston 17. Also visible is part of cross member 34.

FIG. 4 also shows both pulley systems. As stated above, the first pulley system includes pulleys 19, 21, and 23, and FIG. 4 shows that pulley 23 in fact comprises two pulleys, attached within pulley frame 57. The second pulley system, including pulleys 25, 27, and 23, is also shown in FIG. 4. Cords 43 and 45, of the first and second pulley systems, respectively, are also visible.

The operation of the training device can be described most clearly with reference to FIGS. 1 and 2. The user 39 applies force against handle members 11, while carriage 9 is still disposed on horizontal track portion 5. As the user pushes the carriage forward, cord 43 is pulled upward, and towards the right, due to its connection to the forward end of carriage arm 13. The position of pulleys 19, 21, and 23, and the fact that cord 43 is affixed to the frame by eyebolt 31, cause pulley 23 to be raised, pushing piston 17 into cylinder 15. The hydraulic or pneumatic pressure in the cylinder tends to resist the movement of the piston into the cylinder, and thus imparts resistance to the movement of the carriage, as felt by the user.

Eventually, the user 39 pushes the carriage 9 up the track, as shown in FIG. 2. At this point, much of the piston 17 is inserted into the cylinder 15, due to the pulling of cord 43 by carriage arm 13. When the user releases the carriage 9, the carriage arm 13 pulls cord 45. Due to the position of pulley 27, and the fact that cord 45 passes over pulley 23 and is fastened to the frame at eyebolt 29, the downward movement of the carriage along the track causes the piston 17 to be moved out of the cylinder, and back to its original position. Without the action of this second pulley system, the piston 17 would remain inserted into the cylinder. The second pulley system therefore resets the device prior to the next cycle.

By exerting force first in a horizontal and then in a vertical direction, the user learns to shift his weight in a manner tending to lift his opponent from the ground. As seen in FIG. 1, most of the player's weight is initially directed in the forward direction. In FIG. 2, most of the force is directed vertically. At some point between the positions shown in FIGS. 1 and 2, the player must smoothly shift the direction of his exerted force from horizontal to vertical. By lifting the opponent from the ground, the player temporarily immobilizes the opponent, and prevents him from assisting the other members of the team.

The hydraulic or pneumatic pressure in the cylinder can be varied. A gauge (not shown in the figures) can be provided for setting and monitoring the pressure in the cylinder. The pressure can, in fact, be changed rapidly, while the carriage is moving upward, to simulate increasing levels of resistance by an opposing player. Alternatively, the pressure can be increased or decreased between attempts to move the carriage up the track, with the pressure being held constant during each such trial.

It is understood that other means of imparting resistance to the movement of the carriage can be employed. A system of hanging weights could be used, for example, in place of the cylinder. Such weights would act as the means of generating the opposing force necessary to retard the movement of the carriage upwardly along the track. The weights could be varied to provide different levels of resistance, although the force exerted by the weights would not be continuously variable, as would be true of the pressurized fluid cylinder system.

The present invention is not limited to use as a football training device. The invention can be used as a means of exercise by persons who are not football players. Exercise can be obtained by repeatedly pushing the carriage up the track, possibly with varying amounts of resistance from the cylinder and piston.

The present invention enjoys the advantage that it is relatively portable. While it is suited to training of football players, it does not require a football field for use. The device can be used indoors or outdoors, and therefore can provide exercise and/or training during all seasons. In particular, the device can be used to maintain the skills of football players between football seasons.

While the invention has been described with respect to particular embodiment, shown in the drawings, it is understood that the invention can be practiced in many other ways. As stated above, the hydraulic or pneumatic cylinder can be replaced with equivalent means. The design of the carriage, the amount and location of padding, and the configuration of the carriage arm, can also be changed. Various other means of attachment of the cords, other than eyebolts, can also be employed. The structure of the frame can be varied considerably, and the structure and number of pieces of the track can be changed. These and other similar modifications are to be deemed within the spirit and scope of the following claims.

What is claimed is:

1. A device for training football players in the art of blocking, the device comprising:

(a) a frame, the frame including a track, the track having a horizontal portion and an upwardly sloping portion, (b) a carriage having a set of rollers, the rollers being adapted to fit around the track, wherein the carriage is attached to the track by the rollers, and wherein the carriage is adapted to move along the track, (c) a piston and a cylinder, said piston being positioned in and reciprocally movable within said cylinder, the cylinder having means for connection to a source of pressurized fluid, wherein the movement of the piston within said cylinder will be retarded, and (d) tackle means connecting the piston to the carriage, the connection between the piston and the carriage being such that the piston is urged towards one end of the cylinder when the carriage is moved upwardly along the track.

2. The device of claim 1, wherein the tackle means comprises a first tackle means and a second tackle means, the first tackle means being connected to urge the piston towards said one end of the cylinder when the carriage is moved upwardly along the track, and the second tackle means being connected to move said piston towards said other end of the cylinder when the carriage moves down the track.

3. The device of claim 2, wherein the carriage has handle means, the handle means being adapted for pushing ahnd lifting by a user of the device, and wherein the carriage has a carriage arm, connected to the first and second tackle means.

4. The device of claim 3, wherein the first tackle means includes a first cord and a plurality of the first pulleys, said first cord having one of its ends affixed to the carriage arm, the first cord passing around said first pulleys and having its other end attached to said frame, wherein upward movement of the carriage arm causes the first cord to force said piston upwards.

5. The device of claim 4, wherein the second tackle means includes a second cord and a plurality of a second pullyes, said second cord having one of its ends connected to the carriage arm, passing around said second pulleys and having its other end attached to said frame, wherein downward movement of the carriage arm causes the second cord to force said pulley downwards.

6. A training device for football players, comprising;

a carriage means;

a track means, said carriage means being affixed to said track means and movable along said track means, said track means having a generally horizontal portion and an upwardly sloping portion, said upwardly sloping portion having a substantially uniform slope, said track means including a gradual transition portion from said horizontal portion to said upwardly sloping portion, said track means defining a path of travel for said carriage means, and means for imparting resistance to said carriage means as it travels upwardly along said track means, wherein at least a portion of said resistance imparting means is distinct from said carriage means, padded handle means, said padded handle means being connected to said carriage means, wherein force exerted on said handle means tends to push said carriage means along said track, said resistant imparting means comprises pulley means, cord means, and an opposing force means, wherein said opposing force means is connected to said carriage means by the cord means, through said pulley means, wherein movement of the carriage means upwardly along said track means is opposed by said opposing force means.

7. The device of claim 6, wherein the opposing force means comprises a cylinder and a piston, the cylinder having means for connection to a source of fluid pressure, wherein the pulley means and the cord means are connected so as to urge the piston into the cylinder as the carriage means is pushed upwardly along the track means.

8. A training device for football players, comprising:

a frame, said frame defining a track having a generally horizontal portion and an upwardly sloping portion, said upwardly sloping portion having a substantially uniform slope, said track including a gradual transition portion from the horizontal portion to said upwardly sloping portion, a carriage, said carriage having a set of rollers, said carriage being attached to said track by said rollers, said carriage being capable of movement upwardly or downwardly along said track, and means for generating resistance to movement of said carriage upwardly along said track, wherein at least a portion of the said resistance generating means is distinct from said carriage, a tackle system, said tackle system being connected between said carriage and said resistance generating means, wherein movement of said carriage upwardly along said track transmits a force through said tackle system causing said resistance generating means to retard movement of said carriage.

9. The device of claim 8, wherein the resistance generating means comprises pressurized fluid storage means, and piston means movably positioned in said into the fluid storage means.

10. The device of claim 9, wherein a first tackle system is connected to said piston means and said carriage to move the piston means within the fluid storage means in response to upward movement of the carriage along the track.

11. The device of claim 10, further comprising a second tackle system, the second tackle system being connected to the carriage and to the piston means to move the piston means from the fluid storage means when the carriage is moved downwardly along the track.

12. A training device for football players, comprising:

(a) a frame, the frame defining a track having a generally horizontal portion and an upwardly sloping portion, (b) a carriage, the carriage having a set of rollers, the carriage being attached to the track by the rollers, the carriage being capable of movement upwardly or downwardly along the track, (c) means for generating resistance to the movement of the carriage upwardly along the track, and (d) a tackle system, the tackle system being connected between the carriage and the resistance generating means, wherein movement of the carriage upwardly along the track transmits a force through the tackle system causing the resistance generating means to retard the movement of the carriage, wherein the resistance generating means comprises pressurized fluid storage means, and piston means in said fluid storage means, wherein the tackle system is connected so as to move the piston means within the fluid storage means in response to upward movement of the carriage along the track, the device further comprising a second tackle system, the second tackle system being connected to the carriage and to the piston means, so as to retract the piston means in said fluid storage means when the carriage is moved downwardly along the track.

* * * * *